US007137810B2

(12) United States Patent
Tschöp et al.

(10) Patent No.: US 7,137,810 B2
(45) Date of Patent: Nov. 21, 2006

(54) PIEZO IGNITION DEVICE

(75) Inventors: Roland Tschöp, Hässelby (SE); Christer Hansson, Stockholm (SE)

(73) Assignee: Primus AB (SE)

( * ) Notice: Subject to any disclaimer, the term of this patent is extended or adjusted under 35 U.S.C. 154(b) by 79 days.

(21) Appl. No.: 10/488,899

(22) PCT Filed: Aug. 29, 2002

(86) PCT No.: PCT/SE02/01544

§ 371 (c)(1),
(2), (4) Date: Mar. 8, 2004

(87) PCT Pub. No.: WO03/021152

PCT Pub. Date: Mar. 13, 2003

(65) Prior Publication Data

US 2005/0074714 A1 Apr. 7, 2005

(30) Foreign Application Priority Data

Sep. 6, 2001 (SE) ..... 0102962

(51) Int. Cl.
*F23Q 3/00* (2006.01)
*A47J 37/00* (2006.01)

(52) U.S. Cl. ..... 431/264; 431/255; 126/25 B

(58) Field of Classification Search ..... 431/264, 431/255, 265; 126/25 B, 39 E; 313/118
See application file for complete search history.

(56) References Cited

U.S. PATENT DOCUMENTS 2,896,334 A * 7/1959 Dunderman ..... 33/652
3,404,940 A * 10/1968 Chappuy ..... 431/264
3,431,058 A * 3/1969 Hufferd ..... 431/264
4,302,181 A 11/1981 Schlosser
5,934,896 A * 8/1999 Kwiatek ..... 431/266

* cited by examiner

*Primary Examiner*—Alfred Basichas
(74) *Attorney, Agent, or Firm*—Banner & Witcoff, Ltd.

(57) ABSTRACT

A piezo ignition device (1) includes a piezo electric crystal (16), which is intended to generate a spark on an electrode (3) in said device when subjected to force. The ignition device (1) is mounted parallel with a mixer pipe (5) for delivering fuel to an open-air cooking apparatus, and the piezo electric crystal (16) is arranged so that the force applied to the crystal is directed parallel with the mixer pipe (5), wherein the force acting on the ingition device (1) for the ignition of said device is arranged to be applied parallel with said ignition device (1) in a direction from the electrode (3).

14 Claims, 2 Drawing Sheets

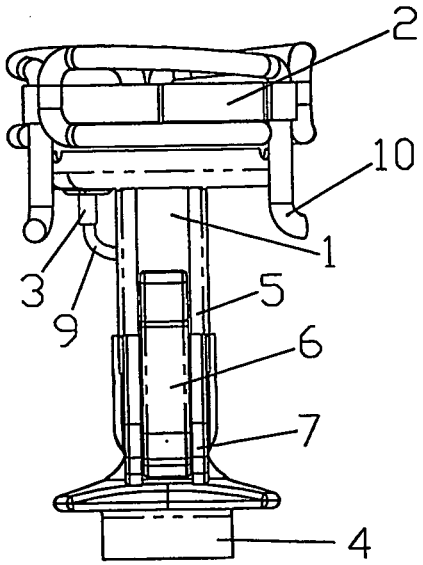
Fig 1
Fig 2
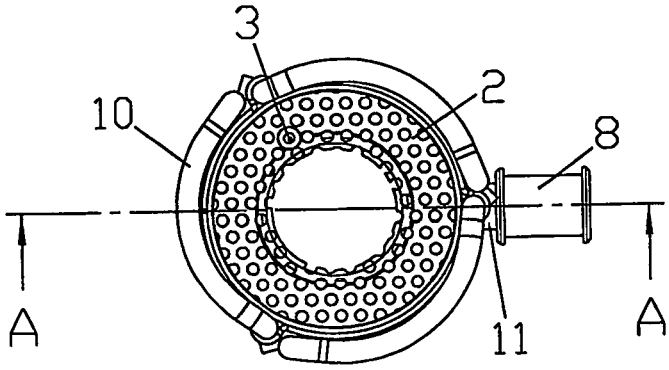
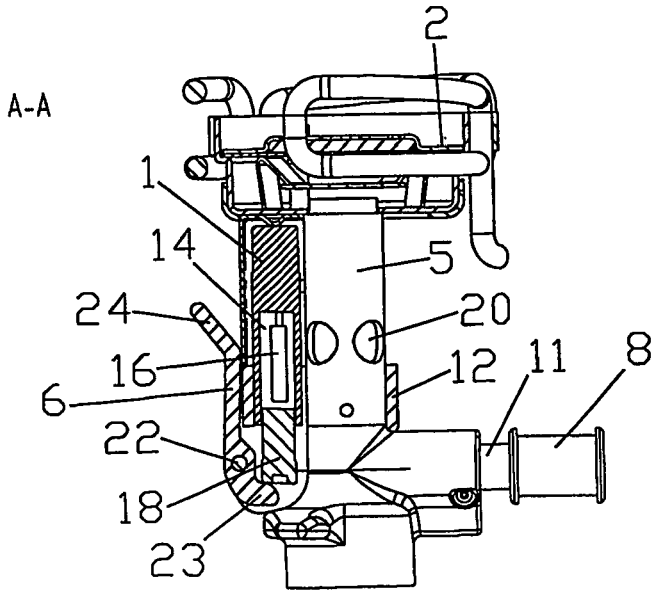
Fig 3

PIEZO IGNITION DEVICE

FIELD OF INVENTION

The present invention relates to permanently fitted piezo-type ignition devices used for igniting a fuel mixture in connection with open-air cooking apparatus, such as outdoor camping stoves for example.

DESCRIPTION OF THE BACKGROUND ART

Piezo ignition devices fitted to open-air cooking apparatus for igniting the burner of said apparatus are known, inter alia, from Swedish Patent Specification 9603139-8 (513 251). This patent publication teaches a piezo ignition device fitted as an ancillary at right angles to the burner-mixing pipe. The ignition spark is delivered to the upper side of the burner via an electrode located on the outside of the burner. The ignition device is activated by pressing a button, it being necessary to constantly "hold against" the opposite side, which requires the provision of means to protect against the heat generated by the apparatus. It may also be necessary to surround the ignition device with diverse protective plates in order to protect against the heat generated by the burner.

The U.S. Patent Specification U.S. Pat. No. 4,302,181 teaches a piezo ignition device for igniting a gas grill, wherein the device is applied with its power-effect in a direction parallel with the burner mixing pipe. However, this ignition device is activated by pressing the device upwards with one finger, therewith moving the device to an appropriate position in the burner in a first ignition stage, and thereafter by continuing to press the ignition device in the same direction in a second ignition stage, such as to produce an ignition spark. The applied upward pressure also means that it is necessary to "hold against" the grill with this type of ignition device, so as to prevent the grill from being lifted in its entirety as a result of the finger pressure applied to the device.

It is therefore necessary with both of these earlier known gas mixture ignition devices to activate a counter-pressure device which functions to exert an oppositely directed force, in order to control ignition of the cooking apparatus.

OBJECT OF THE INVENTION

The object of the present invention is to solve the aforesaid problem and to provide a piezo ignition device with which ignition can be effected more simply, primarily with regard to an outdoor cooker but also with regard to other forms of open-air equipment that can be ignited suitably with a fitted piezo ignition device.

Another object is to provide a piezo ignition device which is fitted parallel with the mixing pipe of the open-air cooking equipment and which is also arranged so that the force applied to produce an ignition spark will not jeopardise the stability of the equipment.

SUMMARY OF THE INVENTION

These objects are fulfilled by the present invention as defined in the independent Claim, therewith eliminating the drawbacks mentioned above. Suitable further embodiments of the invention are defined in the dependent Claims.

The invention relates to a system comprising a piezo ignition device which is mounted parallel with the mixing pipe of said system and with which the ignition device is activated by directing the force that is applied manually to ignite said device parallel with the device and in a direction away from the burner electrode, for example through the medium of a lever or a pressure element such that the force applied to the piezo ignition device will have a stability enhancing effect on the system.

According to a first embodiment, the lever acts against the lower part of the ignition device and may also be fitted with a pull element in the form of chain or link, so as to enable the lever to be maneuvered from a place remote from the burner.

According to a second embodiment, the pressure element acts against the upper part of the ignition device and may also be provided with a pull chain or link.

In the case of open-air cooking apparatus, the electrode extends through the bottom of the burner and ignition is effected on the upper side thereof. The electrode is sealed-off by means of a high-temperature resistant packing clamped between two metal plates. The piezo ignition device is protected against heat in this system with the aid of the burner, while the sensitive electrode is protected by being placed in said burner.

In addition, the invention provides a more compact design and ergonomically improved activation of the ignition device.

BRIEF DESCRIPTION OF THE DRAWINGS

The invention will now be described in more detail with reference to an exemplifying embodiment thereof and also with reference to the accompanying drawings, in which FIG. 1 illustrates an open-air cooking apparatus to which a piezo ignition device is fitted in accordance with a first embodiment of the invention;

FIG. 2 illustrates the cooking apparatus of FIG. 1 from above, with the piezo ignition device fitted;

FIG. 3 is a sectional view of the piezo ignition device and the burner taken on the line A—A, with the remaining parts of the cooking apparatus not sectioned;

DESCRIPTION OF THE INVENTION

Figure 4:
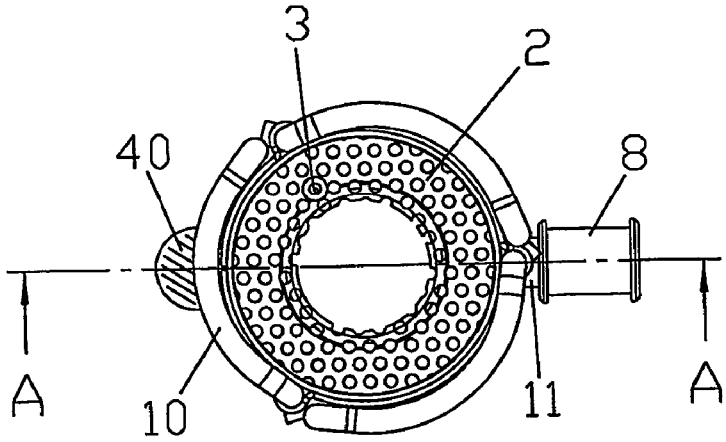
FIG. 4 illustrates a second embodiment of the invention.

FIG. 1 illustrates an open-air cooking apparatus that has a piezo ignition device 1 fixedly mounted thereon, in accordance with the invention. The illustrated embodiment of the open-air cooking apparatus includes a gas burner 2 through which the electrode 3 of said device 1 extends, said electrode functioning to generate an ignition spark. The cooking apparatus is connected to a fuel source by means of a fuel supply fitting 4. As the cooking apparatus is screwed onto a fuel container (not shown) a pin in the fuel supply fitting activates a valve in the container so as to cause the valve to open and therewith allow fuel to flow into a mixer pipe 5. The fuel is passed to the burner 2 at the top of the mixer pipe 5, therewith allowing the electrode 3 of the ignition device to ignite the outflowing fuel. The piezo ignition device 1 is manoeuvred by a lever 6 mounted in the lower end 7 of said device.

Extending between the ignition device 1 and its electrode 3 is a flexible electric cable 9 which enables the electrode 3 to be positioned through the burner, at a distance from the upper end of said device. The illustrated apparatus also includes three outwardly foldable vessel supports 10.

FIG. 2 illustrates the embodiment of FIG. 1 from above, and clearly shows the burner 2 of the cooking apparatus. In the illustrated case, the burner has the form of a bottled-gas burner. Also shown in FIG. 2 is the electrode 3 of said ignition device, said electrode extending through the burner from beneath and terminating on the upper side of the burner. Also shown is a control knob 8 which co-acts with a valve for the supply of fuel to the burner 2 through the mixer pipe 5. The figure also shows the three vessel supports 10 from above. When not in use, the supports are intended to be brought into contact with the perimeter or circumference of the cooking apparatus, and are moved out to act as supports for cooking vessels, such as saucepans, frying pans, coffeemakers, when the apparatus is in use, as shown in the figure. The knob 8 can be turned to regulate the setting of a control valve 11, so as to increase or decrease the supply of fuel from a fuel container connected to the cooking apparatus.

FIG. 3 includes a sectioned view of the piezo ignition device 1 and the burner 2, taken on the line A—A in FIG. 2. The remaining parts of the cooking apparatus have not been sectioned. The piezo ignition device 1 is shown in FIG. 3 as a cylindrical body, which is mounted parallel with and in close relationship with the mixer pipe 5 of said apparatus. The ignition device is mounted at the lower end of the mixer pipe, by means of a clamping ring 12 which embraces the pipe 5 and firmly holds the device 1 to said pipe. The cylindrical body of said ignition device 1 includes a space 14, which houses a piezo electric crystal 16. The space 14 is cylindrical in shape. The arrangement includes a plunger 18, which is adapted to be pressed into said space from beneath. Because the plunger 18 functions to compress the piezo electric crystal 16, electric current will be caused to flow through the ignition device 1 and therewith generate a spark in the electrode 3 of said device. Because the control valve 11 has been opened by the knob 8, fuel will flow through the mixer pipe 5 and up to the burner 2 of said apparatus, wherewith the outflowing fuel is ignited by the spark generated by the electrode. The fuel flowing through the mixer pipe is mixed with air from one or more primary air intakes 20 in the mixer tube, such that the fuel flowing out through the burner will consist of an air/fuel mixture. The plunger 18 is moved transversely into the cylindrical space 14, therewith compressing the piezo electric crystal 16, by means of a lever 6 which is pivotally mounted on a pivot pin 22 such that the short arm 23 of the lever lies against the bottom end of the plunger 18. The longer arm 24 of the lever includes an outwardly bent upper part and constitutes the maneuvering end of said lever, thereby providing a transmission effect for maneuvering of the plunger. The pivot pin of the lever is orientated at right angles to the symmetry axis of the mixer pipe, although not in the same plane.

The lever is manufactured preferably by sawing or otherwise cutting an extruded aluminium profile having the cross-sectional shape shown in FIG. 3 into appropriate lengths, wherein each length defines the width of the lever as shown in FIG. 1. The hole receiving the pivot pin is conveniently provided when manufacturing the profile, therewith obviating the need for further processing or treatment in this respect.

The aforedescribed arrangement in which a lever 6 is mounted on a pivot pin 22 means that the force applied to the lever 6 for ignition of the cooking apparatus has a stabilising effect on said apparatus, since the force generates a moment of force about the pivot pin 22 at the same time as said pin is subjected to a vertically downwards stabilising force. Although not shown, the piezo ignition device, with its lever 6 and/or the plunger 18 of said device also includes spring means for exerting a restoring force on the lever so as to return the lever to its non-actuated position, which is the position shown in FIG. 3.

Figure 5:
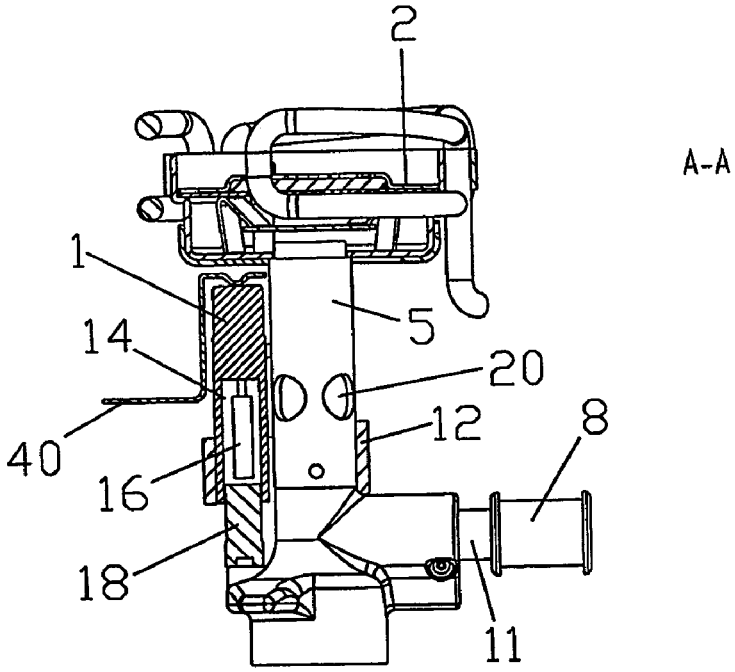
FIG. 5 is a sectioned view of the second embodiment shown in FIG. 4.

FIGS. 4 and 5 illustrate a second embodiment of the invention, in which the same numerical references as those used in respect of the first embodiment have also been used to identify corresponding components. The burner 2 of the cooking apparatus according to this embodiment also has the form of a bottled-gas burner. Also shown in FIG. 4 is the electrode 3 of the ignition device, said electrode extending through the burner from beneath and terminating on the upper side of said burner. Also shown is a control knob 8, which actuates a valve for the supply of fuel to the burner 2 through a mixer pipe. The figure shows from above three vessel supports 10 which are intended to be brought into abutment with the circumference or perimeter of the cooking apparatus when not in use, as shown in the figure, and to be brought to positions in which they support cooking vessels, such as saucepans, frying pans and coffeemakers when the apparatus is in use. Rotation of the knob 8 results in actuation of a control valve 11 so as to increase or decrease the supply of fuel from a fuel container connected to the cooking apparatus. Also shown in the figure is a pressure element 40 which is manually loaded in a vertical direction, either directly or indirectly, so as to ignite a piezo ignition device.

FIG. 5 includes a sectioned view of a piezo ignition device 1 and a burner 2 taken on the line A—A, with the remaining components of the cooking apparatus not being sectioned. In the FIG. 5 illustration, the ignition device 1 has the form of a cylindrical body which is mounted parallel with and in the close proximity of the mixing pipe 5 of the cooking apparatus. The ignition device is mounted at the lower end of the mixer pipe with the aid of a clamping ring 12, which embraces the mixer pipe 5 and holds the ignition device 1 firmly to the pipe. The cylindrical body of the ignition device 1 includes a space 14, which houses a piezo electric crystal 16. The space 14 is cylindrical in shape and is intended to be pressed down over a plunger 18. Because the cylinder and the plunger 18 enable compression of the piezo electric crystal 16, there is obtained through the ignition device 1 an electric current which generates a spark in the electrode of said device, in a manner corresponding to that described with reference to the first embodiment. As a result of the knob 8 having opened the control valve 11, fluid will flow through the mixer pipe 5 and up to the burner 2 of said apparatus, wherewith the outflowing fuel is ignited by the spark from the electrode. The fuel flowing through the mixer pipe is mixed with air from one or more primary air intakes 20 in the mixer pipe, wherewith the fuel flowing out through the burner will have the form of an air/fuel mixture. The plunger 18 is moved transversely into the cylindrical space 14 so as to compress the piezo electric crystal 16 by means of a pressure element 40 fixedly mounted on the upper end of the ignition device 1, said pressure element being movable axially down over the plunger 18 fixedly connected to the mixer pipe 5. The pressure element 40 is comprised of an angled plate fastened to the top of the ignition device and extending down towards the centre of said device, from which the plate extends at right angles out from said device.

Although the invention has been described above with reference to a bottled-gas cooking apparatus which is screwed onto a fuel source, it will be understood that the invention is not restricted to such cooking apparatus but can be used with other types of open-air cooking apparatus and open-air equipment that are spark ignited or that lie within the scope of the inventive concept.

The invention claimed is:

1. A piezo ignition device which includes a piezo electric crystal that is intended to generate a spark on an electrode of said device in response to force exerted on the crystal, wherein the ignition device is mounted parallel with and is firmly clamped to a mixer pipe by a clamping ring which delivers fuel to an open-air cooking apparatus, and wherein the piezo electric crystal is positioned so that the force applied to the crystal is directed parallel with the mixer pipe, wherein the force acting on the piezo ignition device for ignition purposes is adapted to be applied parallel with and to one side of the piezo ignition device in a direction from the electrode by a lever which functions to produce the force acting on said piezo electric crystal and the lever includes a short lever end and a long lever end, and wherein the lever is mounted on a pivot pin which is oriented at right angles to said mixer pipe, so that said short lever end is adapted to displace the plunger, said long lever end having an angled portion and a longer straight portion, the clamping ring having a length proximate to the longer straight portion of the long lever end, such that when a pulling force is exerted on said angled portion of the long lever end, the open-air cooking device remains stable.

2. A piezo ignition device according to claim 1, wherein the lever acts on a plunger which is adapted to act transversely and directly on the crystal in said device.

3. A piezo ignition device according to claim 2, wherein the lever and the plunger are adapted to return to their non-actuated positions subsequent to actuation of the lever.

4. A piezo ignition device according to claim 1, wherein a pressure element mounted adjacent said device and functioning to move part of the ignition device into compressive action against the crystal when actuated in a vertical direction.

5. A piezo ignition device according to claim 4, wherein the pressure element is adapted to act on the upper part of the ignition device.

6. A piezo ignition device according to claim 5, wherein an upper part of said device has a cylindrical form.

7. A piezo ignition device according to claim 1, the electrode of the ignition device extendings through a burner so that spark generation will take place on an upper side of the burner.

8. A piezo ignition device which includes a piezo electric crystal that is intended to generate a spark on an electrode of said device in response to force exerted on the crystal, wherein the ignition device is mounted parallel with and is firmly clamped to a mixer pipe which delivers fuel to an open-air cooking apparatus, and wherein the piezo electric crystal is positioned so that the force applied to the crystal is directed parallel with the mixer pipe, wherein the force acting on the piezo ignition device for ignition purposes is adapted to be applied parallel with and to one side of the piezo ignition device in a direction away from the electrode by a lever which functions to produce the force acting on said piezo electric crystal and the lever includes a short lever end and a long lever end, and wherein the lever is mounted on a pivot pin which is oriented at right angles to said mixer pipe, so that said short lever end is adapted to displace the plunger and said long lever end comprises an angled portion and a longer straight portion, the straight portion being parallel and proximate to said piezoelectric device and said mixer piper in its unactuated position, a clamping ring for clamping the piezoelectric device to the mixing pipe proximate to said straight portion of said long lever end such that a pulling force exerted on said angled portion of said long lever end generates a moment of force about the pivot pin at the same time as said pivot pin is subjected to a vertically downwards stabilizing force.

9. A piezo ignition device according to claim 8, wherein the lever acts on a plunger which is adapted to act transversely and directly on the crystal in said device.

10. A piezo ignition device according to claim 9, wherein the lever and the plunger are adapted to return to their non-actuated positions subsequent to actuation of the lever.

11. A piezo ignition device according to claim 8, wherein a pressure element mounted adjacent said device and functioning to move part of the ignition device into compressive action against the crystal when actuated in a vertical direction.

12. A piezo ignition device according to claim 11, wherein the pressure element is adapted to act on the upper part of the ignition device.

13. A piezo ignition device according to claim 12, wherein an upper part of said device has a cylindrical form.

14. A piezo ignition device according to claim 8, the electrode of the ignition device extending through a burner so that spark generation will take place on an upper side of the burner.

* * * * *